US008118098B2

(12) United States Patent
Hromas et al.

(10) Patent No.: US 8,118,098 B2
(45) Date of Patent: Feb. 21, 2012

(54) FLOW CONTROL SYSTEM AND METHOD FOR USE IN A WELLBORE

(75) Inventors: Joe C. Hromas, Sugar Land, TX (US); Larry Grigar, East Bernard, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 492 days.

(21) Appl. No.: 11/419,837

(22) Filed: May 23, 2006

(65) Prior Publication Data

US 2007/0272410 A1 Nov. 29, 2007

(51) Int. Cl.
*E21B 34/06* (2006.01)
*E21B 29/02* (2006.01)

(52) U.S. Cl. ..... 166/298; 166/386; 166/66.7; 166/55; 166/332.1

(58) Field of Classification Search ..... 166/297, 166/299, 373, 374, 386, 55, 316, 319, 332.1, 166/66.7
See application file for complete search history.

(56) References Cited

U.S. PATENT DOCUMENTS

| | | | | |
|---|---|---|---|---|
| 4,473,121 | A | 9/1984 | Nicholl et al. | |
| 4,664,184 | A * | 5/1987 | Grigar | 166/55.1 |
| 4,768,594 | A | 9/1988 | Akkerman | |
| 4,971,160 | A * | 11/1990 | Upchurch | 175/4.54 |
| 5,301,755 | A * | 4/1994 | George et al. | 166/297 |
| 5,490,563 | A * | 2/1996 | Wesson et al. | 166/297 |
| 5,718,289 | A | 2/1998 | Schnatzmeyer et al. | |
| 5,754,495 | A | 5/1998 | Skinner | |
| 5,865,254 | A * | 2/1999 | Huber et al. | 166/373 |
| 5,887,654 | A | 3/1999 | Edwards et al. | |
| 5,890,539 | A | 4/1999 | Huber et al. | |
| 5,957,199 | A | 9/1999 | McLean et al. | |
| 6,012,518 | A | 1/2000 | Pringle et al. | |
| 6,173,772 | B1 * | 1/2001 | Vaynshteyn | 166/250.15 |
| 6,182,750 | B1 | 2/2001 | Edwards et al. | |
| 6,213,203 | B1 | 4/2001 | Edwards et al. | |
| 6,244,351 | B1 | 6/2001 | Patel et al. | |
| 6,296,061 | B1 | 10/2001 | Leismer | |
| 6,302,216 | B1 | 10/2001 | Patel | |
| 6,318,469 | B1 | 11/2001 | Patel | |
| 6,321,838 | B1 | 11/2001 | Skinner | |
| 6,354,374 | B1 | 3/2002 | Edwards et al. | |
| 6,520,255 | B2 * | 2/2003 | Tolman et al. | 166/281 |
| 6,550,538 | B1 | 4/2003 | Herrmann et al. | |
| 6,550,541 | B2 | 4/2003 | Patel | |
| 6,598,682 | B2 * | 7/2003 | Johnson et al. | 166/370 |
| 7,090,033 | B2 | 8/2006 | Chan | |
| 7,337,850 | B2 * | 3/2008 | Contant | 166/375 |
| 2002/0046845 | A1 | 4/2002 | Rayssiguier et al. | |
| 2007/0056724 | A1 | 3/2007 | Spring | |

(Continued)

FOREIGN PATENT DOCUMENTS

CA 2483174 A1 4/2005

(Continued)

*Primary Examiner* — William P Neuder
*Assistant Examiner* — Robert E Fuller
(74) *Attorney, Agent, or Firm* — Rodney Warfford; Chadwick Sullivan

(57) ABSTRACT

A technique is provided to facilitate fluid flow and pressure control in a well with an interventionless flow valve system. The valve system is coupled to a well component string deployed downhole in a wellbore. The valve system controls flow and pressure between an interior and exterior of the string and comprises a valve controlled by an activation device. The activation device is responsive to a unique pressure and time signal transmitted downhole.

13 Claims, 5 Drawing Sheets

U.S. PATENT DOCUMENTS

| | | | |
|---|---|---|---|
| 2007/0056745 | A1 | 3/2007 | Contant |

FOREIGN PATENT DOCUMENTS

| | | | |
|---|---|---|---|
| EP | 0295922 | A2 | 12/1988 |
| EP | 0295922 | | 10/1993 |
| EP | 1076156 | | 2/2001 |
| EP | 1076156 | A2 | 2/2002 |
| GB | 2076450 | A | 12/1981 |
| GB | 2248465 | | 4/1992 |
| GB | 2248465 | A | 4/1992 |
| GB | 2406123 | | 3/2005 |
| GB | 2431674 | | 5/2007 |
| GB | 2431943 | A | 5/2007 |
| GB | 2431674 | A | 2/2009 |
| RU | 2161698 | C2 | 10/2001 |
| WO | 00/47868 | | 8/2000 |
| WO | 01/57358 | | 8/2001 |
| WO | 01/65061 | | 9/2001 |
| WO | 0165061 | A1 | 9/2001 |

* cited by examiner

FLOW CONTROL SYSTEM AND METHOD FOR USE IN A WELLBORE

BACKGROUND

In well procedures related to perforating, valves are sometimes combined with the perforating string moved downhole. The valves can be used to control flow in the downhole environment during, for example, production of fluids or isolation of wellbore regions for specific procedures.

The valves are actuated by a variety of mechanisms and procedures. In some designs, valve actuation is initiated by the shearing of shear pins. Other valves are explosively triggered or mechanically actuated by dropping a bar from a surface location. Each of these valve designs requires intervention for actuation.

SUMMARY

In general, the present invention provides a well related system that utilizes an interventionless valve system to control flow of fluid in a downhole environment. The valve system comprises at least one intelligent valve selectively actuated by a device responsive to a unique pressure and time signal. Actuation of the valve controls fluid flow between the interior of a well equipment string, e.g. a perforating gun string, and exterior regions within the wellbore.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for controlling flow of fluid in a downhole environment. In various well related operations, a valve system can be used to, for example, equalize or isolate pressure between an interior of tubing or other equipment and the exterior region. The valve system is useful in downhole perforating operations to equalize pressure or to isolate pressure from the inside of the tubing of the perforating gun string to the outside of the perforating gun string. Furthermore, the valve system is designed as an interventionless system.

Figure 1:
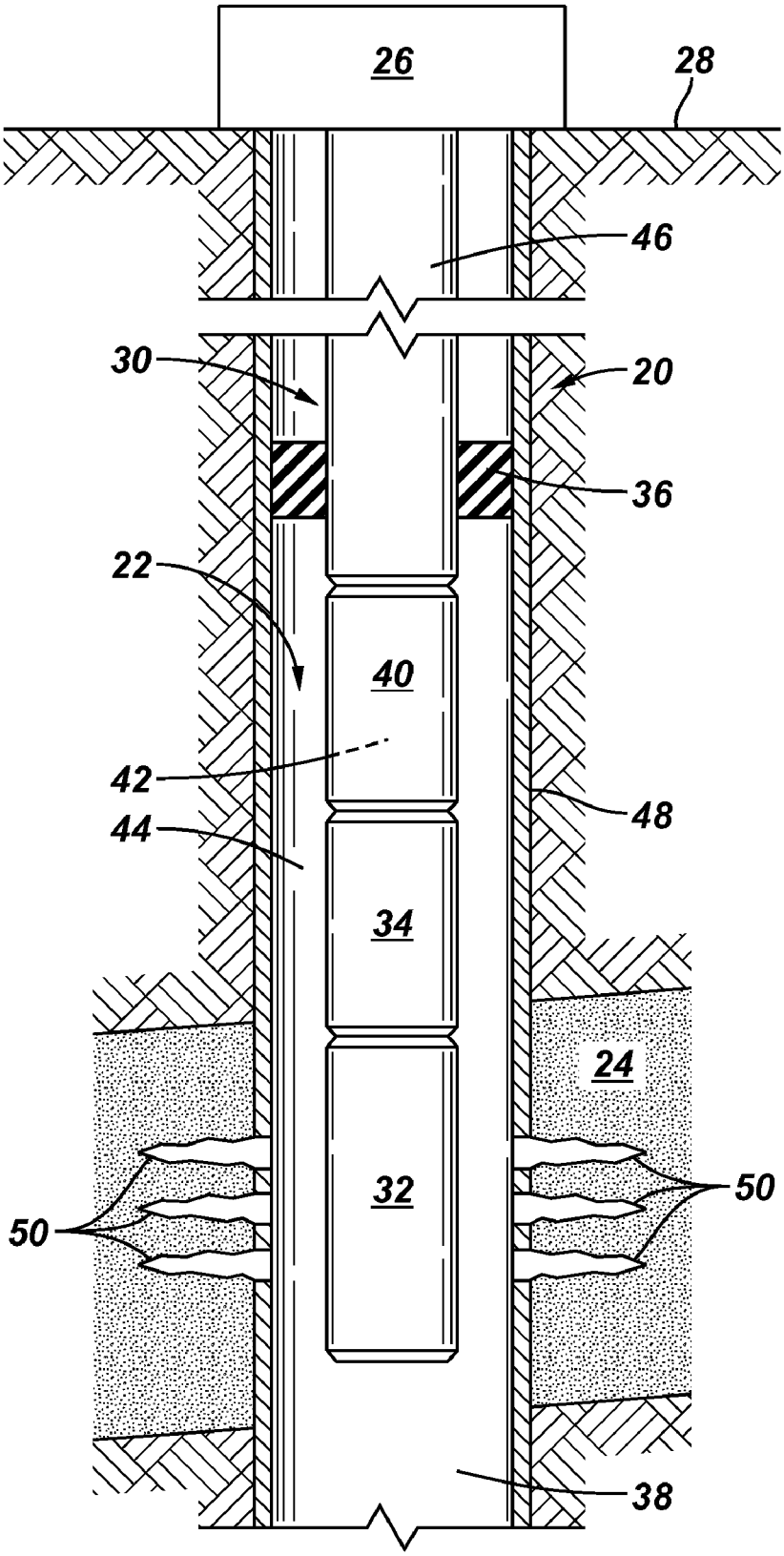
FIG. 1 is an elevation view of a wellbore with a well equipment string therein, according to an embodiment of the present invention.

Referring generally to FIG. 1, a well 20 comprises a wellbore 22 that extends downwardly through one or more subterranean formations 24. The formations 24 often hold desired production fluids, such as hydrocarbon based fluids. In the example illustrated, wellbore 22 extends downwardly from a wellhead 26 located at a surface 28 above wellbore 22. Surface 28 may comprise a surface of the earth or a seabed floor.

A well equipment string 30 is deployed in wellbore 22 and a may have a variety of configurations depending on the specific well operation to be performed. In many applications, well equipment string 30 is a perforating gun string having one or more perforating guns 32 and a firing head 34. A wellbore isolation mechanism 36, such as a packer, can be used to isolate regions of wellbore 22, such as a rat hole region 38 located below packer 36. A valve system 40 is combined with the well equipment string 30, e.g. a perforating gun string, to control flow and to equalize or isolate pressures between an interior 42 of the string, typically the tubing interior, and an exterior 44 that surrounds the string within wellbore 22

Depending on the specific application, string 30 can be deployed into wellbore 22 by a variety of deployment mechanisms 46, such as tubing. Also, wellbore 22 may be lined with a casing 48 that is perforated upon detonation of perforating gun 32 to form perforations 50. Perforations 50 enable, for example, the flow of hydrocarbon fluids from formation 24 into wellbore 22 and/or the flow of well treatment fluids from wellbore 22 into the surrounding formations.

Figure 2:
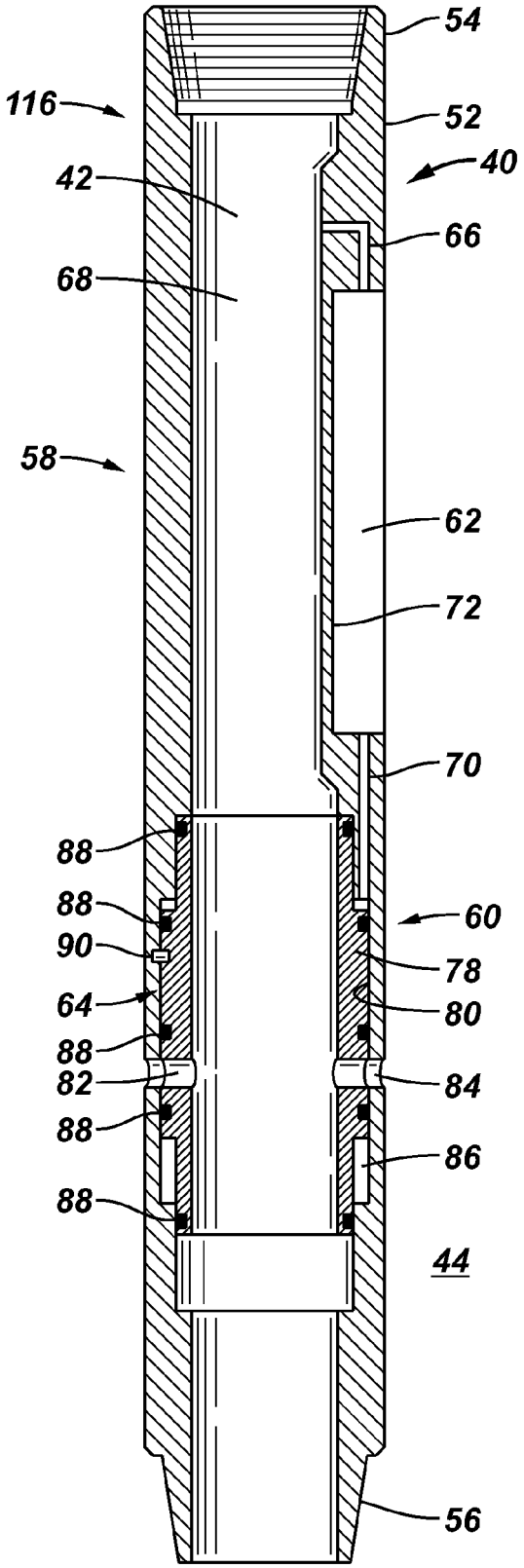
FIG. 2 is a schematic illustration of a valve system that may be combined with the well equipment string, illustrated in FIG. 1, according to an embodiment of the present invention.
Figure 3:
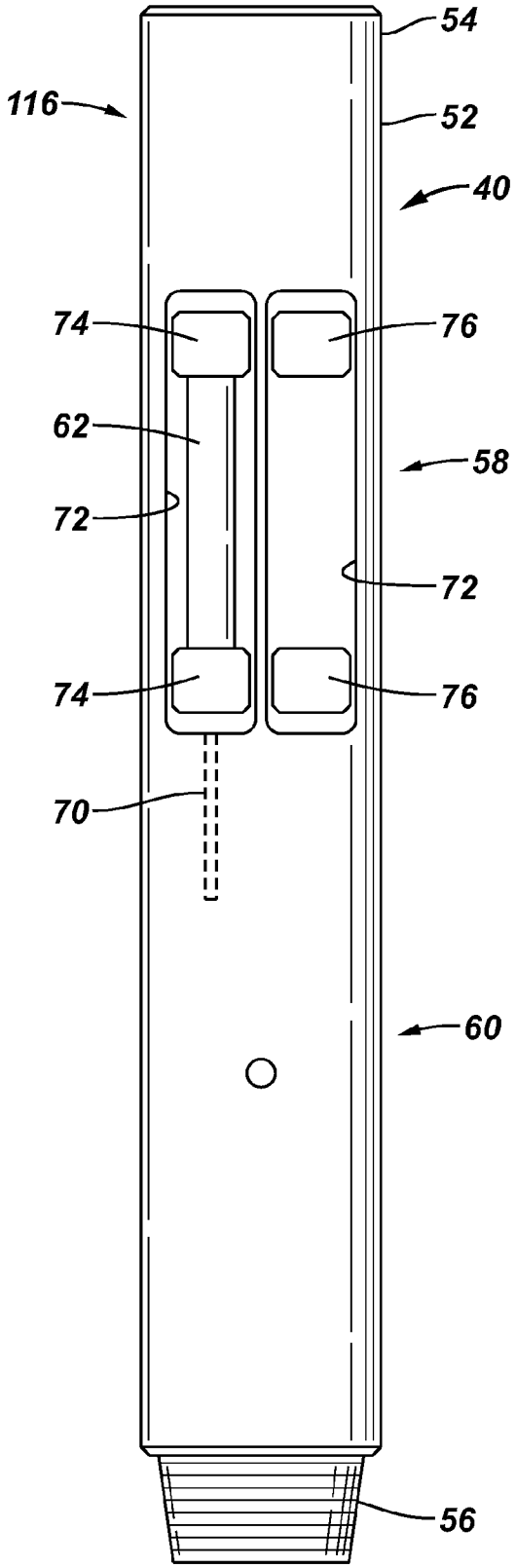
FIG. 3 is a schematic illustration similar to that of FIG. 2 but showing the valve system from a different angle, according to an embodiment of the present invention.

An embodiment of valve system 40 is illustrated in FIGS. 2 and 3. In this embodiment, valve system 40 is a modular system having an outer housing 52 that may be coupled into the well equipment string 30 by, for example, a first connector end 54 and a second connector end 56 opposed from connector end 54. In the embodiment illustrated, connector ends 54 and 56 are internally threaded and externally threaded ends, respectively. Housing 52 generally comprises a main body section 58 and a valve section 60 that may be formed as an integral unit or as separable modular sections held together by fasteners, such as threaded ends or bolts.

Main body section 58 is designed to accommodate one or more activation devices 62 used to activate one or more corresponding valves 64 located in valve section 60. In the embodiment illustrated in FIG. 2, a single activation device 62 is used to activate a single valve 64. The activation device 62 is responsive to a pressure and time signal transmitted downhole through wellbore 22 instead of through hydraulic control lines extending to the surface. When the unique pressure and time signal is received, activation device 62 activates valve 64 from a first state to a second state, e.g. from an open position to a closed position or from a closed position to an open position. The unique pressure and time signal may comprise low pressure signals sent downhole according to a specific time sequence. In other words, the pressures, e.g. pressure pulses, can be applied at a pressure lower than pressures typically used with devices actuated by pressure applied downhole.

The pressure and time signal may be transmitted to activation device 62 via a sensing port 66 located in housing 52. The sensing port 66 can be exposed to an interior 68 of housing 52 if the pressure and time single is transmitted downhole within tubing string 46. Housing interior 68 forms a portion of the overall interior 42 of the tubing string. Alternatively, sensing port 66 can be directed to the exterior of the outer housing 52 to receive a pressure and time signal transmitted through the wellbore annulus surrounding string 30. In the embodiment illustrated, receipt of the appropriate pressure and time signal, causes activation device 62 to open an activation port 70 to hydrostatic pressure in the wellbore. This pressure is used to actuate valve 64, as explained in greater detail below.

Main body section 58 can be a side pocket mandrel type design with room for one or more activation devices 62. In this design, the activation devices 62 are mounted externally along housing 52. The interior 68 through the main body section 58 is offset from the true tool centerline to provide sufficient wall thickness for mounting activation devices 62 while maintaining a large internal flow path. Also, the activation devices 62 may be mounted in corresponding slots 72 formed in housing 52 (see also FIG. 3) and connected to the corresponding sensing port 66 and activation port 70 via sealable blocks 74. In the specific embodiment illustrated, housing 52 comprises two slots 72, as illustrated best in FIG. 3. One of the slots 72 contains the activation device 62 cooperating with valve 64, and the other slot 72 remains blank. Any ports 66, 70 in the unused slot can be sealed shut with appropriate blanking blocks 76. By way of example, blocks 74 and blanking blocks 76 can be sealed to outer housing 52 via o-ring type face seals. Additionally, blocks 74 and blanking blocks 76 can be attached to housing 52 via a variety of suitable mechanisms, such as capscrews.

Referring again to FIG. 2, valve 64 comprises a valve sleeve 78 that slides within a cylindrical region 80 of valve section 60 formed along an interior of housing 52. Valve sleeve 78 comprises at least one and often a plurality of sleeve ports 82 that extend between an interior and exterior of the sleeve. For example, sleeve ports 82 may be in the form of radial ports extending through valve sleeve 78. Housing 52 comprises corresponding ports 84 that complete a pathway between interior 42 and exterior 44 when valve 64 is in an open position such that sleeve ports 82 and corresponding ports 84 are generally aligned.

In the embodiment illustrated, valve 64 is designed for deployment downhole in an open state. An atmospheric chamber 86, such as an air chamber, may be positioned to allow the sleeve to shift when pressure is allowed through activation port 70. Once the pressure and time signal is transmitted downhole to activation device 62, activation port 70 is opened to hydrostatic pressure of the wellbore. The hydrostatic pressure drives valve sleeve 78 toward chamber 86 and moves sleeve ports 82 out of alignment with corresponding ports 84, thereby closing valve 64 and blocking communication between interior 42 and exterior 44. Additionally, a plurality of seals 88, e.g. o-ring seals, can be positioned between valve sleeve 78 and the interior of housing 52, as illustrated. Seals 88 can be used to isolate, for example, chamber 86, sleeve ports 82, and the outlet of activation port 70 through which pressure is introduced against valve sleeve 78. A retention mechanism 90 also can be used to maintain valve sleeve 78 and valve 64 in a desired state during deployment and/or to maintain valve sleeve 78 and valve 64 in the actuated state once valve sleeve 78 is shifted, e.g. shifted from an open position to a closed position.

Figure 4:
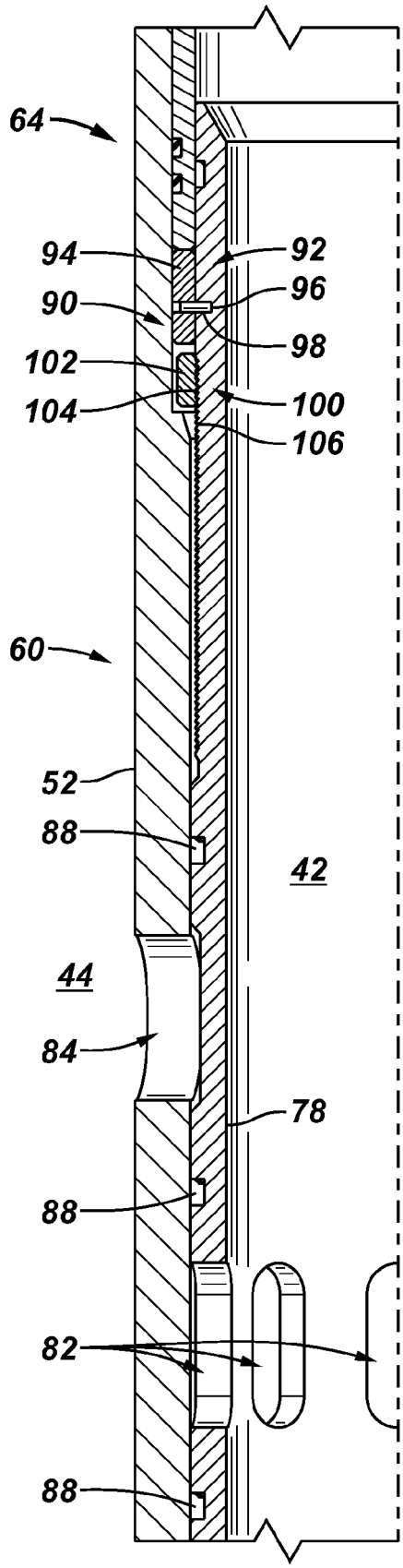
FIG. 4 is an expanded view of a valve retention system, according to an embodiment of the present invention.

Referring generally to FIG. 4, an example of a retention mechanism 90 is illustrated in greater detail. In the embodiment illustrated, valve 64 is in a closed state during deployment into wellbore 22. In other words, sleeve ports 82 and corresponding ports 84 of housing 52 are out of alignment and isolated by seals 88. During this initial phase, valve sleeve 78 is retained in its original state via retention mechanism 90. In this embodiment, retention mechanism 90 comprises a shear mechanism 92 having a shear ring 94 held by housing 52 and at least one shear pin 96 which extends radially from shear ring 94 into at least one corresponding mating hole 98 within valve sleeve 78. The shear ring 94 and the at least one shear pin 96 are used to hold valve sleeve 78 in position so sleeve 78 is not inadvertently shifted while running valve system 40 and perforating gun string 30 downhole.

Retention mechanism 90 also may comprise a mechanism 100 for holding valve sleeve 78 in its shifted state, e.g. an open state once sleeve 78 is shifted from the illustrated closed position to an open position. In the embodiment illustrated, mechanism 100 comprises a ratchet ring 102 secured along housing 52 and having a plurality of ratchet teeth 104. Ratchet teeth 104 are positioned to slide along a gripping region 106 of valve sleeve 78 and are designed to enable gripping region 106 and thus valve sleeve 78 to move in one direction but not the other. Accordingly, valve sleeve 78 can be actuated from a first state to a second state, but mechanism 100 prevents return movement of the valve sleeve 78 once positioned in the second state.

Figure 5:
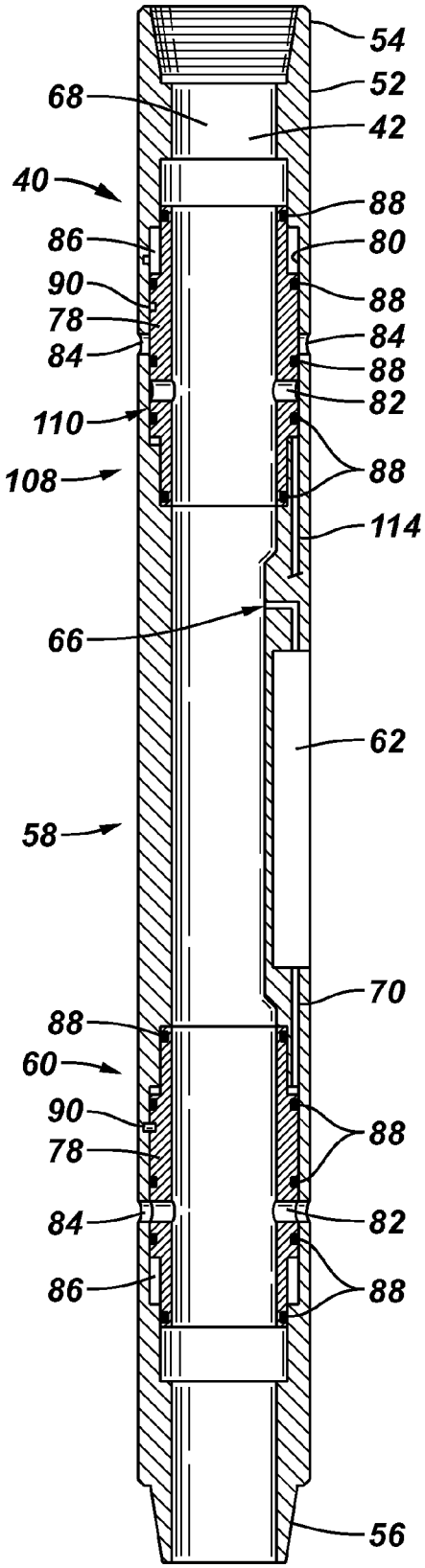
FIG. 5 is a schematic illustration of an alternate embodiment of the valve system illustrated in FIG. 2, according to an embodiment of the present invention.
Figure 6:
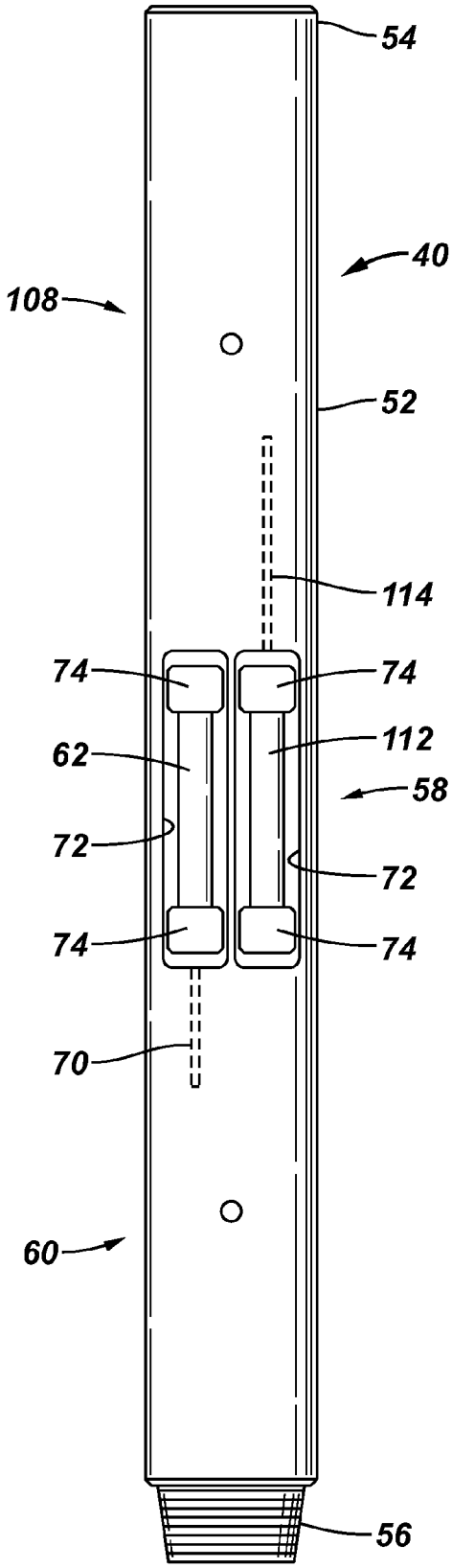
FIG. 6 is a schematic illustration similar to that of FIG. 5 but showing the valve system from a different angle, according to an embodiment of the present invention.

Another embodiment of valve system 40 is illustrated in FIGS. 5 and 6. In this embodiment, valve system 40 also is a modular system in which outer housing 52 generally comprises main body section 58, valve section 60 and an additional valve section 108 having a valve 110 similar to valve 64. As illustrated, the additional valve section 108 may be located on an opposite side of main body section 58 from valve section 60. Valve section 108 also may be formed as an integral part of housing 52 or as a detachable modular section.

Main body section 58 is designed to accommodate activation device 62 and at least one additional activation device 112 used to activate valves 64 and 110, respectively. Activation device 112 also is responsive to a unique pressure and time signal transmitted downhole through wellbore 22. When the unique pressure and time signal is received, activation device 112 activates valve 110 from a first state to a second state, e.g. from a closed position to an open position. The pressure and time signal used to activate valve 110 may comprise low pressure signals sent downhole according to a specific time sequence and can be unique relative to the pressure and time signal used to activate valve 64.

The pressure and time signal may be transmitted to activation device 112 via sensing port 66 or through an additional sensing port located in housing 52. As with the embodiment illustrated in FIGS. 2 and 3, the sensing port can be exposed to an interior 68 of housing 52 if the pressure and time single is transmitted downhole within the tubing string 46. Or, the sensing port can be directed to the exterior of the outer housing 52 to receive a pressure and time signal transmitted through the wellbore annulus surrounding well equipment string 30. Receipt of the appropriate pressure and time signal causes activation device 112 to open an activation port 114 to hydrostatic pressure in the wellbore.

As illustrated best in FIG. 6, the activation devices 62 and 112 are mounted in the slots 72 formed in housing 52. The activation devices 62 and 112 may be connected to their corresponding sensing ports and activation ports via sealable blocks 74.

Valve 110 is similar to valve 64 and common reference numerals have been used to label common components in valves 110 and 64. By way of example, valve 110 may comprise valve sleeve 78 slidably mounted within cylindrical region 80 of valve section 108 formed along an interior of housing 52. The valve sleeve 78 of valve 110 similarly comprises at least one and often a plurality of sleeve ports 82 that extend between an interior and exterior of the sleeve. Housing 52 comprises corresponding ports 84 located in valve section 108 that complete a pathway between the interior 42 and the exterior 44 when valve 110 is in an open position such that sleeve ports 82 and corresponding ports 84 are generally aligned, as described above with reference to valve 64. Valve 110 also comprises its own atmospheric pressure, e.g. air, chamber 86 and seals 88 to isolate the desired regions along valve sleeve 78. Valve 110 also may incorporate retention mechanism 90 to limit inadvertent movement of sleeve 78. In some embodiments, each section 108 and 60 also can incorporate a shock absorber in line with sleeve 78 to reduce any shock and deformation to sleeve 78 as it is shifted to its final position. In other embodiments, the valve sleeves 78 can be designed to incorporate internal shifting profiles as a backup to enable the valves to be opened or closed with standard shifting tools.

In the embodiment illustrated, valve 64 is initially placed in an open position, and valve 110 is initially placed in a closed position. However, valves 64 and 110 can be placed in different initial states depending on the wellbore application in which valve system 40 is utilized. Additionally, the actual operation of valve system 40 and the sequence of valve openings and/or closings can vary from one wellbore application to another. Furthermore, housing 52 can be designed as a modular housing so that valve system 40 can be converted from a dual valve system to a single valve system by removing valve section 108 and substituting a different modular top sub 116 (see FIG. 2) in conjunction with replacing the second activation device 112 with blanking blocks 76.

In one example of the operation of well equipment string 30, valve system 40 comprises a single valve embodiment, such as the embodiment described with reference to FIGS. 2 and 3. In this embodiment, valve system 40 is combined with a perforating gun string in which an automatic gun drop can be performed. Initially, the perforating gun string and the valve system 40, with single valve 64, is moved downhole into the wellbore 22 with valve 64 in the open position. Valve 64 is maintained in the open position to automatically fill the tubing string. Once the perforating gun string and valve system 40 arrives at the proper depth, a cushion fluid, such as a lighter cushion fluid, is pumped down the tubing 46 to displace the heavier well fluid. Packer 36 is then set, and the appropriate pressure and time signal is transmitted downhole. Upon receiving the specific pressure and time signal, activation device 62 opens activation port 70 and valve 64 is exposed to hydrostatic well pressure which moves sleeve 78 to a closed position. The closed valve traps the appropriate pressure in rat hole 38 below automatic gun release (not shown) drops the gun string into the wellbore and opens up the tubing 46 which was used to deploy the gun string downhole. At this point, well fluid, such as hydrocarbon based fluid, can flow upwardly through the tubing to the surface.

In another example of the operation of well equipment string 30, valve system 40 comprises a dual valve embodiment, such as the embodiment described with reference to FIGS. 5 and 6. In this embodiment, valve system 40 is combined with a perforating gun string in which an automatic gun drop is not required or in which the gun string is moved into a highly deviated or horizontal well where drop-off is not possible. Initially, the perforating gun string and the valve system 40, with dual valves 64 and 110, is moved downhole into the wellbore 22 with valve 64 in the open position and valve 110 in the closed position. Valve 64 is maintained in the open position to automatically fill the tubing string. Once the perforating gun string and valve system 40 is located at the proper depth, a cushion fluid is pumped down the tubing 46 to displace the heavier well fluid. Packer 36 is then set, and the appropriate pressure and time signal is transmitted downhole to close valve 64. Following closure of valve 64, firing head 34 is initiated and perforating guns 32 are detonated. Subsequently, a second unique pressure and time signal is transmitted downhole and received by activation device 112. Activation device 112 opens activation port 114 to expose valve 110 to hydrostatic well pressure which causes sleeve 78 to shift and transition valve 110 from a closed position to an open position. The open valve 110 enables fluid, such as hydrocarbon fluid, to flow from the wellbore 22 and into tubing 46 for transfer to the surface.

It also should be noted that the above described operations employing either a single valve or a dual valve system can be used to reperforate previously perforated wells by using the procedures described. In other applications, the closure of valve 64 can be used to enable the application of increased pressure within tubing 46 to set a tubing set type packer. Valve system 40, in fact, can be used in a variety of other environments and applications by simply transmitting low pressure and time signals downhole without the intervention of other valve shifting mechanisms.

As described above, the activation devices 62 and 112 are designed to respond to unique pressure and time signals, such as pressure and time signals in the form of low pressure inputs transmitted downhole in a timed sequence. Each activation device is designed to recognize its own corresponding pressure and time signal to enable dependable and selective actuation of the desired valves. The activation devices can be designed with a variety of electrical and mechanical components, however one example is described in the commonly assigned patent application Ser. No. 11/307,843, filed Feb. 24, 2006.

Figure 7:
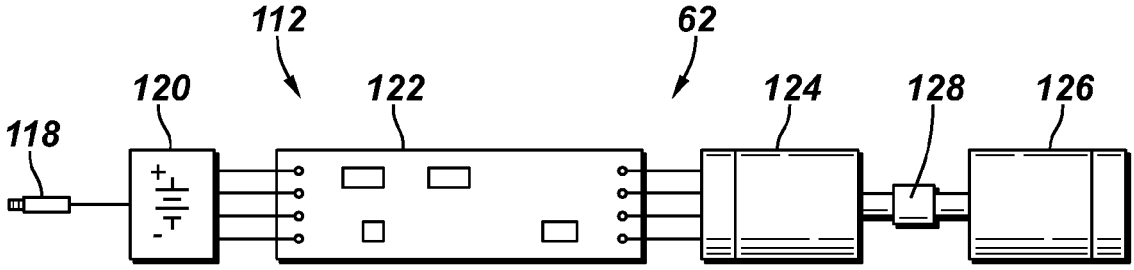
FIG. 7 is a schematic illustration of an embodiment of a trigger system for actuating the valve system, according to an embodiment of the present invention.
Figure 8:
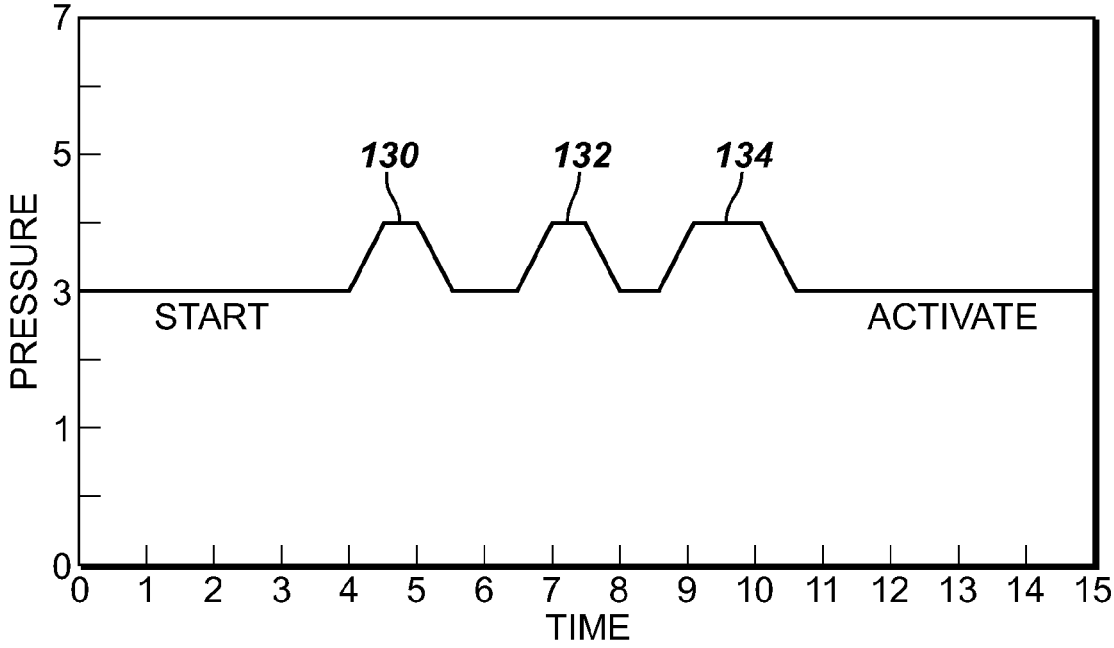
FIG. 8 is a graphical illustration of one embodiment of a pressure and time signal used to activate the trigger system illustrated in FIG. 7, according to an embodiment of the present invention.

In this particular example, as illustrated in FIGS. 7 and 8, each actuation device 62, 112 comprises a pressure sensor 118, a power supply 120, such as a battery, an electronics module 122, a motor 124, an actuation component 126 and a coupler 128 to connect the motor 124 to the actuation component 126. In this embodiment, power supply 120 provides electrical power to electronics module 122 and to motor 124. The pressure sensor 118 detects pressure inputs, such as pressure pulses, transmitted downhole and outputs a corresponding signal to electronics module 122. The electronics module 122 may comprise a microprocessor or other suitable electronics package to detect both the pressure inputs and the timing of the pressure inputs for comparison to a preprogrammed pressure and time signature. Upon receipt of a pressure and time signal matching the preprogrammed signature, the electronics module 122 outputs an appropriate signal to initiate operation of motor 124. Motor 124 moves actuation component 126, via coupler 128, to open the appropriate activation port 70, 114 to initiate movement of the desired valve sleeve 78 and actuation of the valve.

One example of a pressure and time signature is illustrated in FIG. 8, although many unique pressure and time signatures and signals can be utilized for the control of individual valves. For example, the number of pressure pulses may vary, the length of each pressure pulse may vary, and the time between pressure pulses may vary. In the illustrated example, the pressure and time signature comprises three pressure pulses 130, 132 and 134, respectively, located in a unique time sequence. When the pressure and time signal transmitted downhole matches the illustrated signature, the appropriate actuation device 62, 112 is activated to transition the corresponding valve from one state to another.

The specific components used to recognize the pressure and time signal and to activate the corresponding valve can be changed to accommodate differing applications and/or changes in technology. Additionally, the number of valves used in a given valve system and the design of each valve can be adjusted according to the specific well application and/or well environment. Additionally, the valve systems can be used in perforating operations and other well related operations.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a wellbore, comprising:

a perforating gun string having a large internal flow path;

a packer mounted to the perforating gun string; and a valve system mounted to the perforating gun string to control flow between an interior and an exterior of the perforating gun string via at least one radial port extending through a wall of the perforating gun string, the valve system comprising a valve controlled by an activation device responsive to a pressure and time signal, the activation device having electronics to detect both pressure inputs and the timing of the pressure inputs for matching against a predetermined signature, the activation device responding by selectively controlling an activation port that may be opened to enable actuation of the valve by hydrostatic pressure in the wellbore, the valve system being located in a perforating gun string housing so the valve system remains outside of the large internal flow path when actuated between open and closed states, the activation device being mounted in a slot within an outer surface of the perforating gun string housing to maintain the large internal flow path.

2. The system as recited in claim 1, wherein the pressure and time signal comprises low pressure pulse signals sent downhole according to a specific time sequence.

3. The system as recited in claim 1, wherein the valve is maintained in an open position when the valve system is moved downhole into the wellbore.

4. The system as recited in claim 3, wherein the valve comprises a retention mechanism to hold the valve in a shifted position once actuated to the shifted position.

5. The system as recited in claim 1, wherein the valve system further comprises a second valve and a second activation device.

6. The system as recited in claim 5, wherein the valve is maintained in an open position and the second valve is maintained in a closed position when the valve system is moved downhole into the wellbore.

7. The system as recited in claim 1, wherein the valve system further comprises a retention mechanism to maintain the valve in a desired state during deployment into the wellbore.

8. The system as recited in claim 5, wherein the pressure and time signal comprises at least two unique pressure and time signals to enable independent control of the valve and the second valve.

9. A method of employing a perforating system, comprising:

coupling a perforating gun string to a valve system, the perforating gun string having a large internal flow path;

locating the valve system in a perforating gun string housing so the valve system remains outside of the large internal flow path when actuated between open and closed states;

moving the perforating gun string and the valve system to a desired location in wellbore;

detecting a predetermined signature of pressure inputs provided with a specific timing, wherein detecting is accomplished with an actuation device removably mounted in a housing slot along an exterior surface of the perforating gun string housing through which the large internal flow path extends, the housing slot being formed outside the large internal flow path to avoid restricting the large internal flow path; and actuating the valve system upon detection of the predetermined signature by opening an activation port that actuates a valve of the valve system by hydrostatic pressure of the wellbore.

10. The method as recited in claim 9, wherein actuating comprises opening or closing a valve of the valve system in response to a plurality of low pressure pulses applied according to a predetermined time sequence.

11. The method as recited in claim 9, wherein actuating comprises actuating at least two valves via unique pressure and time signals.

12. The method as recited in claim 9, wherein moving comprises running the perforating gun string and the valve system downhole with the valve open between the wellbore and an interior of the gun string.

13. A method of employing a perforating system, comprising:

coupling a perforating gun string to a valve system, the perforating gun string having a large internal flow path;

locating the valve system in a perforating gun string housing so the valve system remains outside of the large internal flow path when actuated between open and closed states;

moving the perforating gun string and the valve system to a desired location in wellbore, wherein moving comprises running the perforating gun string and the valve system downhole with the valve open between the wellbore and an interior of the gun string;

detecting a predetermined signature of pressure inputs provided with a specific timing, wherein detecting is accomplished with an actuation device removably mounted in a housing slot of a housing through which the large internal flow path extends, the housing slot being formed outside the large internal flow path to avoid restricting the large internal flow path;

actuating the valve system upon detection of the predetermined signature by opening an activation port that actuates a valve of the valve system by hydrostatic pressure of the wellbore pumping a cushion fluid downhole through the perforating gun string and out into the wellbore through the valve;

sealing a region of the wellbore with a packer;

closing the valve via the pressure and time signal to trap a desired pressure in the region; and firing a perforating gun of the perforating gun string.

* * * * *